United States Patent [19]

Furukawa

[11] Patent Number: 4,979,479

[45] Date of Patent: Dec. 25, 1990

[54] FUEL INJECTOR AND MOUNTING STRUCTURE THEREOF

[75] Inventor: Hiroshi Furukawa, Obu, Japan

[73] Assignee: Aisan Kogyo Kabushiki Kaisha, Obu, Japan

[21] Appl. No.: 362,368

[22] Filed: Jun. 5, 1989

[30] Foreign Application Priority Data

Jun. 23, 1988 [JP] Japan ..... 63-155752

[51] Int. Cl.[5] ..... F02M 39/00

[52] U.S. Cl. ..... 123/472; 239/533.12; 123/531

[58] Field of Search ..... 123/531, 533, 472, 470, 123/471; 239/533.3, 533.5, 533.7, 533.9, 533.11, 533.12, 585

[56] References Cited

U.S. PATENT DOCUMENTS

| | | | |
|---|---|---|---|
| 4,200,237 | 4/1980 | Urlaub | 239/533.12 |
| 4,254,915 | 3/1981 | Müller | 239/533.12 |
| 4,275,845 | 6/1981 | Müller | 239/533.12 |
| 4,650,122 | 3/1987 | Kenzle | 239/585 |
| 4,657,189 | 4/1987 | Iwata | 239/533.12 |
| 4,773,374 | 9/1988 | Kiuchi | 123/470 |
| 4,813,610 | 3/1989 | Renowden | 239/585 |
| 4,827,888 | 5/1989 | Vaznaian | 123/531 |

FOREIGN PATENT DOCUMENTS

| | | | |
|---|---|---|---|
| 55-71063 | 5/1980 | Japan . | |
| 56-118968 | 9/1981 | Japan . | |
| 57-152458 | 9/1982 | Japan . | |
| 58-90365 | 6/1983 | Japan . | |
| 61-73070 | 5/1986 | Japan . | |
| 61-99669 | 6/1986 | Japan . | |
| 0208666 | 8/1988 | Japan | 123/472 |
| 63-41580 | 11/1988 | Japan . | |
| 0193077 | 8/1989 | Japan | 132/470 |
| 2058905 | 4/1981 | United Kingdom | 123/470 |

*Primary Examiner*—Carl Stuart Miller

*Attorney, Agent, or Firm*—Dennison, Meserole, Pollack & Scheiner

[57] ABSTRACT

A fuel injector for use with an internal combustion engine, including a valve housing having one end formed with a fuel injection hole; a valve member reciprocally movable in the valve housing for opening and closing the fuel injection hole; an actuator for effecting reciprocal movement of the valve member; and a nozzle fixedly mounted to the one end of the valve housing and formed with a fuel atomizer passage. The fuel atomizer passage includes a fuel inlet communicated with the fuel injection hole for inducing the fuel injected from the fuel injection hole, a passage portion inclined at a predetermined angle with respect to a direction of injection of the fuel to be injected from the fuel injection hole and having a uniform cross section over the entire length thereof, which passage portion has a fuel colliding portion for allowing collision of the fuel injected from the fuel injection hole, and a fuel outlet for discharging the fuel atomized in the passage portion and for restricting a divergence and a direction of a fuel spray to be discharged therefrom.

14 Claims, 6 Drawing Sheets

FUEL INJECTOR AND MOUNTING STRUCTURE THEREOF

BACKGROUND OF THE INVENTION

The present invention relates to a fuel injector for use with an internal combustion engine, and more particularly to a fuel injector improved in fuel atomization.

Conventionally, there have been proposed various types of fuel injectors intended to improve fuel atomization and thereby improve combustibility of fuel in a combustion chamber of the internal combustion engine.

For example, Japanese Utility Model Laid-open Publication No. 55-71063 discloses a fuel injector having a needle valve formed at its end with an expanded portion for atomizing fuel. However, as a fuel injection hole in this fuel injector is defined around the needle valve, an annular opening area of the fuel injection hole is vary small, causing plugging of the fuel injection hole due to a foreign matter in the fuel.

Another type fuel injector is disclosed in Japanese Utility Model Laid-open Publication No. 57-152458, for example. This fuel injector is provided with an obstacle as a fuel colliding member at a position downstream of a fuel injection hole, so that the fuel injected from the fuel injection hole may collide with the obstacle to improve fuel atomization. However, it is technically difficult to locate the obstacle in alignment with the fuel injection hole, causing an increase in manufacturing cost.

SUMMARY OF THE INVENTION

It is an object of the present invention to provide a fuel injector which may eliminate plugging of the fuel injection hole and improve fuel atomization with a simple structure at a low manufacturing cost.

It is another object of the present invention to provide an assembly of such an improved fuel injector with an internal combustion engine and an intake manifold.

According to one aspect of the present invention, there is provided a fuel injector for use with an internal combustion engine, comprising a valve housing having one end formed with a fuel injection hole; a valve member reciprocally movable in said valve housing for opening and closing said fuel injection hole; an actuator for effecting reciprocal movement of said valve member; and a nozzle fixedly mounted to the one end of said valve housing and formed with a fuel atomizer passage, said fuel atomizer passage including a fuel inlet communicated with said fuel injection hole for inducing the fuel injected from said fuel injection hole, a passage portion inclined at a predetermined angle with respect to a direction of injection of the fuel to be injected from said fuel injection hole and having a uniform cross section over the entire length thereof, said passage portion having a fuel colliding portion for allowing collision of the fuel injected from said fuel injection hole, and a fuel outlet for discharging the fuel atomized in said passage portion and for restricting a divergence and a direction of a fuel spray to be discharged therefrom.

According to another aspect of the present invention, there is provided an assembly of an internal combustion engine having a suction port and a suction valve for opening and closing said suction port, an intake manifold connected to said internal combustion engine, and a fuel injector mounted to said intake manifold at an angle such that fuel is discharged from said fuel injector toward said suction port, said fuel injector comprising a valve housing having one end formed with a fuel injection hole; a valve member reciprocally movable in said valve housing for opening and closing said fuel injection hole; an actuator for effecting reciprocal movement of said valve member; and a nozzle fixedly mounted to the one end of said valve housing and formed with a fuel atomizer passage, said fuel atomizer passage including a fuel inlet communicated with said fuel injection hole for inducing the fuel injected from said fuel injection hole, a passage portion inclined at a predetermined angle with respect to a direction of injection of the fuel to be injected from said fuel injection hole and having a uniform cross section over the entire length thereof, said passage portion having a fuel colliding portion for allowing collision of the fuel injected from said fuel injection hole, and a fuel outlet for discharging the fuel atomized in said passage portion and for restricting a divergence and a direction of a fuel spray to be discharged therefrom.

With this arrangement, the fuel injected from the fuel injection hole is allowed to collide with the fuel colliding portion of the fuel atomizer passage, thereby atomizing the fuel in the fuel atomizer passage. Then, the atomized fuel is discharged from the fuel outlet of the fuel atomizer passage. The fuel outlet also serves to restrict a divergence and a direction of a fuel spray to be discharged from the nozzle. In the case that the fuel outlet has a circular shape, a spray pattern of the fuel to be discharged from the fuel outlet may be made substantially conical. Further, in the case that air is supplied into the fuel atomizer passage, the fuel atomization may be further improved.

The invention will be more fully understood from the following detailed description and appended claims when taken with the drawings.

DETAILED DESCRIPTION OF THE PREFERRED EMBODIMENTS

Figure 1A:
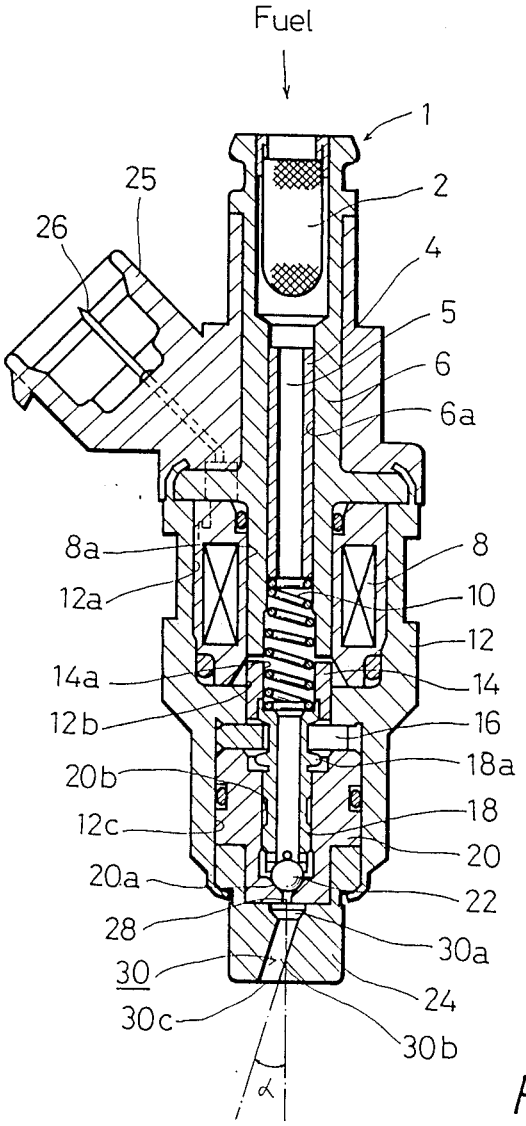
FIG. 1A is a vertical sectional view of the fuel injector of a first preferred embodiment according to the present invention.
Figure 1B:
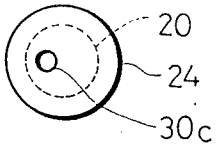
FIG. 1B is a bottom plan view of FIG. 1A.

Referring to FIGS. 1A and 1B, reference numeral 1 generally designates a fuel injector according to the present invention. The fuel injector 1 includes a casing 12 formed with an upper bore **12*a*, intermediate bore 12*b* and lower bore 12*c*. A solenoid coil 8 is fixedly disposed in the upper bore 12*a* of the casing 12, and is electrically connected to terminals 26 fixed in a socket 25. A fixed iron core 6 is fixedly inserted in a central hole 8a of the solenoid coil 8. An armature 14 is slidably inserted in the intermediate bore 12b of the casing 12. A valve housing 20 is fixedly disposed in the lower bore 12c of the casing 12. The valve housing 20 is formed with a central hole 20b for receiving a slidable valve member 18. A fuel injection hole 28 is formed at a lower end of the valve housing 20. The central hole 20b of the valve housing 20 is formed at its lower end portion with a conical valve seat 20a for seating a spherical valve 22. The spherical valve 22 is fixed to a lower end of the valve member 18, and the armature 14 is fixed to an upper end of the valve member 18. A stopper 16 is fixedly interposed between an upper end of the valve housing 20 and an upper inner surface of the lower bore 12c of the casing 12. The valve member 18 is formed with a flange 18a abuttable against a lower surface of the stopper 16. Thus, the valve member 18 is slidably within a predetermined stroke defined between a position where the flange 18a abuts against the lower surface of the stopper 16 and a position where the spherical valve 22 abuts against the valve seat 20a. The fixed iron core 6 is formed with a central hole 6a for fixedly receiving a fuel supply pipe 4 forming a fuel passage 5 therein and a compression coil spring 10 underside of the fuel supply pipe 4. The coil spring 10 is also received in a central hole 14a of the armature 14. Thus, an upper end of the coil spring 10 abuts against a lower end of the fuel supply pipe 4, and a lower end of the coil spring 10 abuts against the upper end of the valve member 18 integrally fixed to a lower end of the armature 14. Accordingly, the valve member 18 is normally downwardly biased by the coil spring 10 to abut the spherical valve 22 against the valve seat 20a. The fuel supply pipe 4 is fixed by caulking to the fixed iron core 6. A fuel strainer 2 is received in the central hole 6a of the fixed iron core 6 upperside of the fuel supply pipe 4** for filtering fuel to be supplied thereinto.

A nozzle 24 is received at its upper portion into the lower bore 12c of the casing 12, and is fixed by caulking to the casing 12. The nozzle 24 is formed with a fuel atomizer passage 30 having a conical fuel inlet 30a formed just underside of the fuel injection hole 28 for inducing the fuel injected from the fuel injection hole 28, an inclined passage portion 30b inclined at a predetermined angle $\alpha$ with respect to an injecting direction of the fuel, and a circular fuel outlet 30c for discharging a restricted divergence of fuel particulates generated in the inclined passage portion 30b. The inclined passage portion 30b extends uniformly straightly from the conical fuel inlet 30a to the circular fuel outlet 30c, and has a circular section taken along a plane perpendicular to an axis of the straight inclined passage portion 30b. Thus, the needle-like flow of fuel injected from the fuel injection hole 28 through the conical fuel inlet 30a is allowed to collide with an inner wall surface of the inclined passage portion 30b to form fine fuel particulates. The nozzle 24 is formed of a free cutting material such as free cutting aluminum alloy from the viewpoints of a reduction in manufacturing cost in the case of unnecessitating a high accuracy of machining.

As shown in FIG. 1B, the circular fuel outlet 30c of the fuel atomizer passage 30 is shifted from a center line of the nozzle 24, that is, from the injecting direction of the fuel.

Figure 2B:
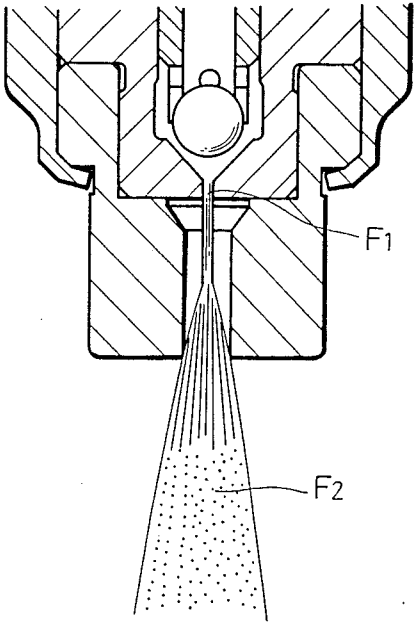
FIG. 2B is a cross section taken along the line A—A' in FIG. 2A.
Figure 2C:
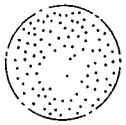
FIG. 2C is a cross section taken along the line B—B' in FIG. 2A.
Figure 2A:
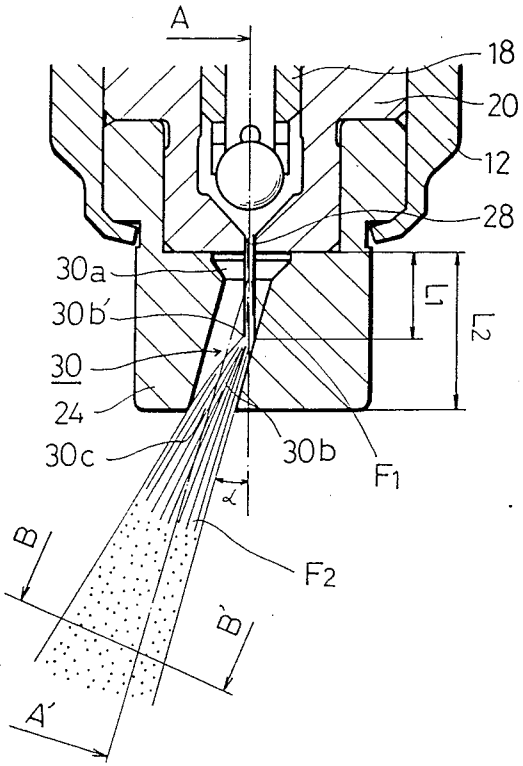
FIG. 2A is an enlarged sectional view of an essential part of FIG. 1A, illustrating fuel atomization.

Referring to FIGS. 2A, 2B and 2C, when current is supplied to the solenoid coil 8 to excite the same, the armature 14 is attracted to the fixed iron core 6 to lift the valve member 18 and thereby open the fuel injection hole 28. As a result, a needle-like flow of fuel F1 is injected from the fuel injection hole 28, and is allowed to collide with a position 30b' of the inner wall surface of the inclined passage portion 30b. The inventors constructed the nozzle 24 having the following dimensions such that a distance L1 between the fuel injection hole 28 and the colliding position 30b' is 4 millimeters; a distance L2 between the fuel injection hole 28 and the circular fuel outlet 30c is 7 millimeters; a diameter of the fuel injection hole 28 is 0.35 millimeters; and a diameter of the circular fuel outlet 30c is 1.9 millimeters. They tested the formation of fuel particulates by using the above-constructed nozzle 24 at a fuel injection rate of 145 cc/min. As the test result, they found that when the angle $\alpha$ is greater than about 5 degrees, the formation of fuel particulates starts, and when the angle $\alpha$ is greater than about 10 degrees, the formation of fine fuel particulates is effected with a particle size of about 200–300 microns. Particularly when the angle $\alpha$ is in the range of about 15–30 degrees, a substantially circular spray pattern having a distribution of density of fuel particulates as shown in FIG. 2C was obtained. That is, the distribution of density of fuel particulates is such that the density at a central portion of the spray pattern is less than that at a peripheral portion of the spray pattern.

Figure 3:
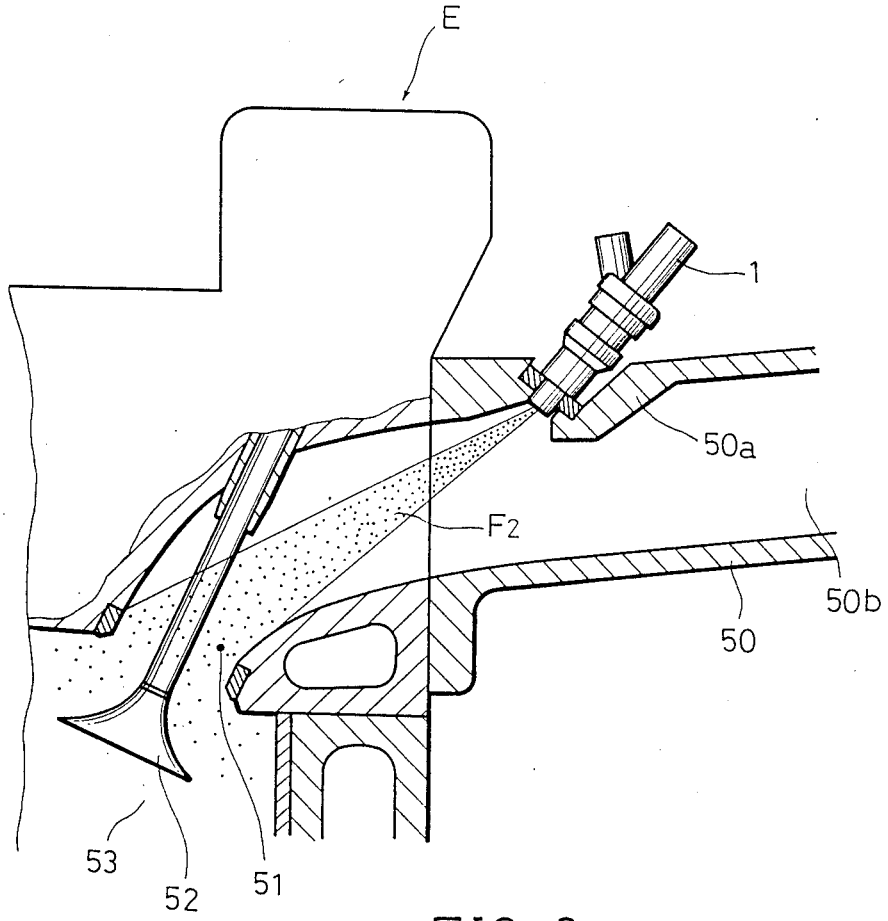
FIG. 3 is a sectional view of an assembly of an internal combustion engine, an intake manifold and the fuel injector shown in FIG. 1A.

Referring to FIG. 3, the fuel injector 1 of the preferred embodiment is mounted to an intake manifold 50 at a mounting portion 50a in such a manner that the fuel discharged from the nozzle 24 of the fuel injector 1 is directed to a suction port 51 of an engine E. As will be apparent from FIG. 3, a mounting angle of the fuel injector 1 relative to the intake manifold 50 is not so small since the direction of flow of fuel particulates from the nozzle 24 is inclined at the angle $\alpha$ from the axis of the fuel injector 1. In comparison with this arrangement of the preferred embodiment, the prior art fuel injector having the direction of fuel flow from the nozzle same as the axis of the fuel injector is required to be mounted at a mounting angle smaller than that shown in FIG. 3, provided that a mounting position is the same, causing projection of the mounting portion 50a into an air passage 50b in the intake manifold 50 more than that shown in FIG. 3, and increasing suction resistance against an air flow in the air passage 50b.

According to the above-mentioned spray pattern having a fuel density distribution such that the density at the central portion of the spray pattern is less than that at the peripheral portion thereof, the fuel particulates discharged from the nozzle may be supplied into a combustion chamber 53 through an annular opening of the suction port 51 when a suction valve 51 is opened as shown in FIG. 3.

Figure 4:
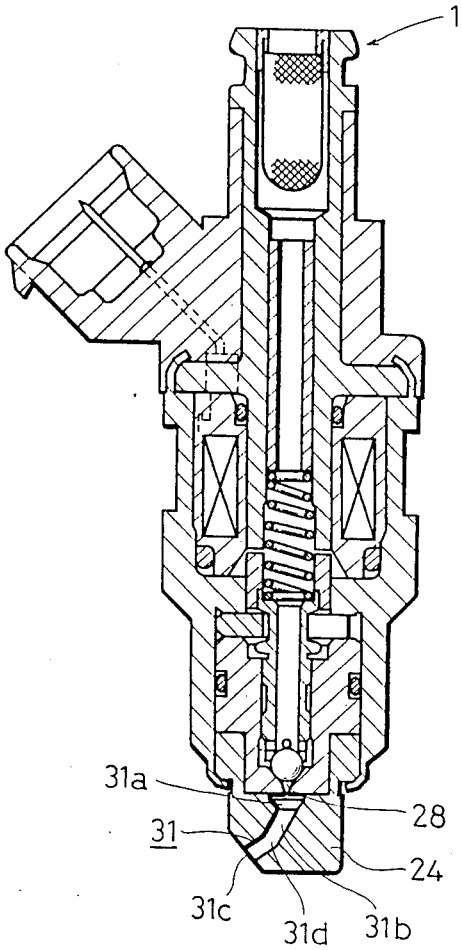
FIG. 4 is a vertical sectional view of the fuel injector of a second preferred embodiment according to the present invention.

Referring next to FIG. 4 which shows a second preferred embodiment of the present invention, the fuel injector shown is similar to that shown in FIG. 1A except for a fuel atomizer passage 31. The fuel atomizer passage 31 includes a conical fuel inlet 31a communicated with the fuel injection hole 28, a first inclined passage portion 31b inclined at the predetermined angle $\alpha$ as previously mentioned in the first preferred embodiment, a second inclined passage portion 31d inclined from the first inclined portion 31b, and a circular fuel outlet 31c for discharging a restricted divergency of fuel particulates.

With this construction, the fuel injected from the fuel injection hole 28 is allowed to collide with an inner wall surface of the first inclined passage portion 31*b*, thereby forming fine fuel particulates. Then, the fine fuel particulates are discharged through the second inclined passage portion 31*d* and the circular fuel outlet 31*c*. In this case, since the second inclined passage portion 31*d* is inclined from the first inclined passage portion 31*b*, the discharging direction of the fuel particulates may be changed from that in the first preferred embodiment. That is, the fuel injector 1 may be mounted to the intake manifold 50 at a mounting angle relative thereto greater than that in the first preferred embodiment, thereby eliminating interference of the fuel injector 1 with peripheral parts to be mounted to the intake manifold 50 near the fuel injector 1. Another way of changing the discharging direction of the fuel particulates without changing the mounting angle relative to the intake manifold may be provided by modifying an inclined angle of the second inclined passage portion 31*d*.

Although the second inclined passage portion 31*d* may be formed from a plurality of branched passages to be led to a plurality of fuel outlets. Further, the shape of the fuel outlet 31*c* may be modified to any shapes other than the circular shape.

Figure 5:
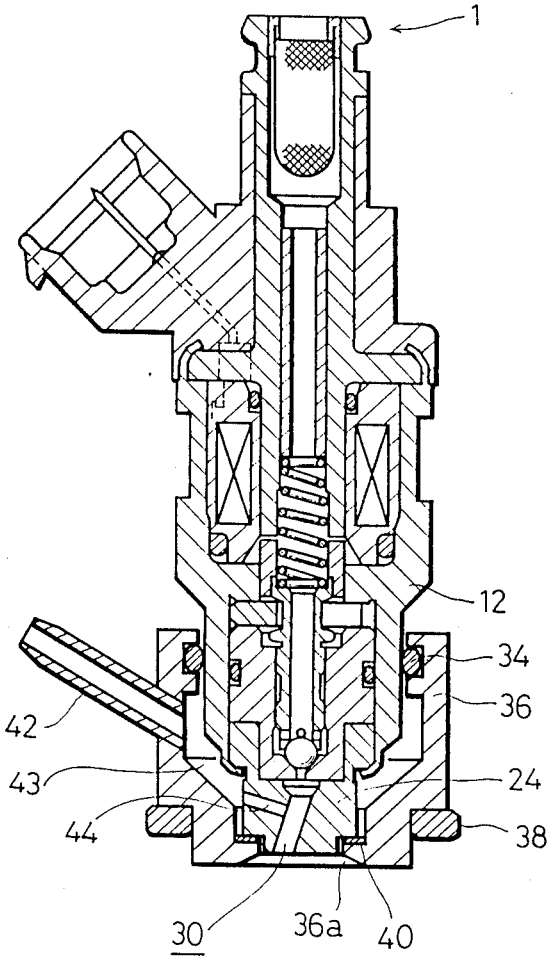
FIG. 5 is a vertical sectional view of the fuel injector of a third preferred embodiment according to the present invention.
Figure 6:
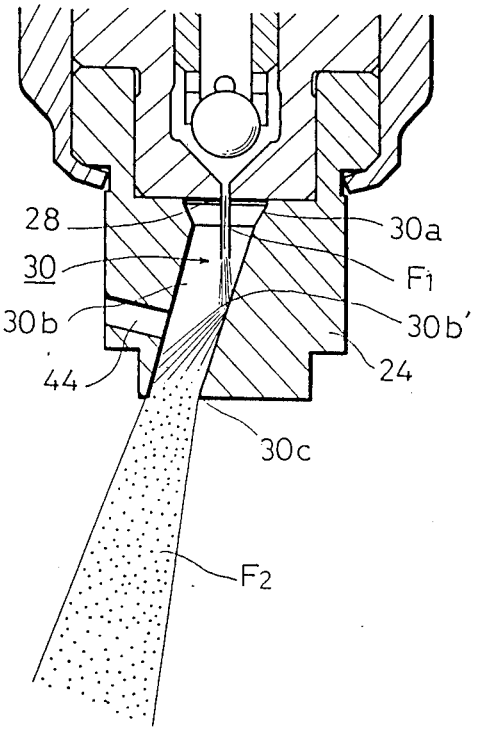
FIG. 6 is an enlarged sectional view of an essential part of FIG. 5, illustrating fuel atomization.

Referring to FIGS. 5 and 6 which show a third preferred embodiment of the present invention, an air passage 44 is formed in the nozzle 24 for supplying air into the fuel atomizer passage 30 similar to that shown in FIG. 1A. An air supplying adapter 36 is so mounted as to surround the nozzle 24 and the lower portion of the casing 12 through O-rings 40 and 34. The air supplying adapter 36 is provided with an air supplying pipe 42 to be communicated with an air intake pipe or a compressor. There is defined an air chamber 43 between an inner surface of the air supplying adapter 36 and an outer surface of the nozzle 24 and the casing 12. The air chamber 43 is sealed by the O-rings 34 and 40. Thus, the air is supplied from the air supplying pipe 42 through the air chamber 43 and the air passage 44 into the fuel atomizer passage 30, so that the atomization of fuel in the fuel atomizer passage 30 may be accelerated by air. The air supplying adapter 36 is formed with a lower opening 36*a* for permitting discharge of the atomized fuel from the fuel outlet 30*c* of the fuel atomizer passage 30. The fuel injector 1 thus constructed is mounted through a packing 38 to the intake manifold 50 as shown in FIG. 3.

As shown in FIG. 6, the air passage 44 opens into the passage portion 30*b* of the fuel atomizer passage 30 at a position downstream of the fuel colliding position 30*b*' on tjhe inner wall surface of the passage portion 30*b*. With this arrangement, the fuel injected from the fuel injection hole 28 collides with the inner wall surface of the passage portion 30*b* at the colliding position 30*b*', thereby forming fine fuel particulates. Then, the fine fuel particulates are further atomized by the air supplied from the air passage 44. The inventors tested fuel atomization by using this fuel injector to realize a fuel particle size of about 50 microns.

It should be appreciate that the shape and the number of the air passage 44 is not limited to the above, and that the construction of the fuel atomizer passage is also not limited to the above.

Having thus described the preferred embodiment of the invention, it should be understood that numerous structural modifications and adaptations may be made without departing from the spirit of the invention.

What is claimed is:

1. A fuel injector for use with an internal combustion engine, comprising:

a valve housing having one end formed with a fuel injection hole;

a valve member reciprocally movable in said valve housing for opening and closing said fuel injection hole;

an actuator for effecting reciprocal movement of said valve member; and a nozzle fixedly mounted to the one end of said valve housing and formed with a fuel atomizer passage, said fuel atomizer passage including a fuel inlet communicating with said fuel injection hole in a direct unobstructed manner for receiving the entire fuel flow injected from said fuel injection hole, a smooth bore passage portion inclined at a predetermined angle with respect to a direction of injection of the fuel to be injected from said fuel injection hole and having a uniform cross section over the entire length thereof, said smooth bore passage portion having a fuel colliding portion for allowing collision of the fuel injected from said fuel injection hole whereby said fuel is reflected off said smooth bore colliding portion to cause atomization of said fuel while at the same time changing the direction thereof, and a fuel outlet for discharging the fuel atomized in said smooth bore passage portion and for restricting a divergence and a direction of a fuel spray to be discharged therefrom.

2. The fuel injector as defined in claim 1, wherein said fuel atomizer passage extends straight in from said fuel inlet to said fuel outlet.

3. The fuel injector as defined in claim 1, wherein said fuel atomizer passage is bent at a position downstream of said fuel colliding portion to change the direction of the fuel spray to be discharged therefrom.

4. The fuel injector as defined in claim 1, wherein said predetermined angle is in the range of about 15–30 degrees to provide a fuel spray pattern having a higher fuel density at a peripheral portion thereof and a lower fuel density at a central portion thereof.

5. The fuel injector as defined in claim 1, wherein said fuel outlet has a substantially circular shape to form a circular cross section of a pattern of the fuel spray to be discharged therefrom.

6. The fuel injector as defined in claim 1, wherein said nozzle further including an air passage communicated with said fuel atomizer passage.

7. The fuel injector as defined in claim 6, wherein said air passage opens into said fuel atomizer passager at a position downstream of said fuel colliding portion.

8. An assembly of an internal combustion engine having a suction port and a suction valve for opening and closing said suction port, an intake manifold connected to said internal combustion engine, and a fuel injector mounted to said intake manifold at an angle such that fuel is discharged from said fuel injector toward said suction port, said fuel injector comprising:

a valve housing having one end formed with a fuel injection hole;

a valve member reciprocally movable in said valve housing for opening and closing said fuel injection hole;

an actuator for effecting reciprocal movement of said valve member; and a nozzle fixedly mounted to the one end of said valve housing and formed with a fuel atomizer passage, said fuel atomizer passage including a fuel inlet communicating with said fuel injection hole in a direct unobstructed manner for receiving the entire fuel flow injected from said fuel injection hole, a smooth bore passage portion inclined at a predetermined angle with respect to a direction of injection of the fuel to be injected from said fuel injection hole and having a uniform cross section over the entire length thereof, said smooth bore passage portion having a fuel colliding portion for allowing collision of the fuel injected from said fuel injection hole whereby said fuel is reflected off said smooth bore colliding portion to cause atomization of said fuel while at the same time changing the direction thereof, and a fuel outlet for discharging the fuel atomized in said smooth bore passage portion and for restricting a divergence and a direction of a fuel spray to be discharged therefrom.

9. The assembly as defined in claim 8, wherein said fuel atomizer passage extends straight from said fuel inlet to said fuel outlet.

10. The assembly as defined in claim 8, wherein said fuel atomizer passage is bent at a position downstream of said fuel passage is bent at a position downstream of said fuel colliding portion to change the direction of the fuel spray to be discharged therefrom.

11. The assembly as defined in claim 8, wherein said predetermined angle is in the range of about 15–30 degrees to provide a fuel spray pattern having a higher fuel density at a peripheral portion thereof and a lower fuel density at a central portion thereof, so that the peripheral portion of the fuel spray having the higher fuel density is effectively induced through a substantially annular opening of said suction port around said suction valve being opened.

12. The assembly as defined in claim 8, wherein said fuel outlet has a substantially circular shape to form a circular cross section of a pattern of the fuel spray to be discharged therefrom.

13. The assembly as defined in clain 8, wherein said nozzle further including an air passage communicated with said fuel atomizer passage.

14. The assembly as defined in claim 13, wherein said air passage opens into said fuel atomizer passage at a position downstream of said fuel colliding portion.

* * * * *